US007367906B2

(12) United States Patent
Tien

(10) Patent No.: US 7,367,906 B2
(45) Date of Patent: May 6, 2008

(54) BASEBALL PRACTICING APPARATUS

(75) Inventor: Feng-Yi Tien, Chia Yi (TW)

(73) Assignee: Acas Design Co., Ltd., Chia Yi (TW)

( * ) Notice: Subject to any disclaimer, the term of this patent is extended or adjusted under 35 U.S.C. 154(b) by 0 days.

(21) Appl. No.: 11/491,603

(22) Filed: Jul. 24, 2006

(65) Prior Publication Data

US 2008/0020870 A1 Jan. 24, 2008

(51) Int. Cl.
*A63B 69/00* (2006.01)

(52) U.S. Cl. ..... 473/451; 473/422

(58) Field of Classification Search ..... 473/422, 473/454, 451, 192, 152, 155; 371/317, 348
See application file for complete search history.

(56) References Cited

U.S. PATENT DOCUMENTS 2,113,899 A * 4/1938 Oram ..... 473/455
3,157,399 A * 11/1964 Gaudet ..... 473/455
3,727,069 A * 4/1973 Crittenden et al. ..... 273/371
4,563,005 A * 1/1986 Hand et al. ..... 473/455
4,763,903 A * 8/1988 Goodwin et al. ..... 273/371
4,770,527 A * 9/1988 Park ..... 473/192
4,949,972 A * 8/1990 Goodwin et al. ..... 473/455
5,333,855 A * 8/1994 Silin et al. ..... 473/455
5,553,846 A * 9/1996 Frye et al. ..... 473/455
5,577,733 A * 11/1996 Downing ..... 273/348
6,159,113 A * 12/2000 Barber ..... 473/454
6,709,351 B2 * 3/2004 Hori ..... 473/455
2005/0137035 A1 * 6/2005 Huang et al. ..... 473/454

* cited by examiner

*Primary Examiner*—Mitra Aryanpour
(74) *Attorney, Agent, or Firm*—Alan Kamrath; Kamrath & Associates PA

(57) ABSTRACT

A baseball practicing apparatus includes two opposite upright frames, two opposite longitudinal rods mounted between the upright frames and provided with a plurality of first emitters and a plurality of first receivers respectively, and two opposite transverse rods mounted between the upright frames and provided with a plurality of second emitters and a plurality of second receivers respectively. Thus, the pitching position of the baseball is detected exactly by provision of the emitters and receivers, so that the user can judge and calibrate the pitching position of the baseball, thereby facilitating the user practicing the pitching skill. In addition, the baseball practicing apparatus detects and displays the pitching position and the velocity of the baseball simultaneously, thereby enhancing the amusement effect.

12 Claims, 6 Drawing Sheets

BASEBALL PRACTICING APPARATUS

BACKGROUND OF THE INVENTION

1. Field of the Invention

The present invention relates to a baseball practicing apparatus and, more particularly, to a baseball practicing apparatus available for a user practicing the baseball.

2. Description of the Related Art

The baseball game is played by multiple players to achieve the exercising and amusing effect. However, a single person cannot play the baseball by himself/herself, so that he/she has to throw the baseball onto the wall to practice the baseball, thereby greatly decreasing the amusement effect.

BRIEF SUMMARY OF THE INVENTION

In accordance with the present invention, there is provided a baseball practicing apparatus, comprising two opposite upright frames, two opposite longitudinal rods mounted between the upright frames and provided with a plurality of first emitters and a plurality of first receivers respectively, and two opposite transverse rods mounted between the upright frames and provided with a plurality of second emitters and a plurality of second receivers respectively.

The primary objective of the present invention is to provide a baseball practicing apparatus that is available for a user practicing the pitching skill.

Another objective of the present invention is to provide a baseball practicing apparatus, wherein the pitching position of the baseball is detected exactly, so that the user can judge and calibrate the pitching position of the baseball, thereby facilitating the user practicing the pitching skill.

A further objective of the present invention is to provide a baseball practicing apparatus, wherein the baseball practicing apparatus detects and displays the pitching position and the velocity of the baseball simultaneously, thereby enhancing the amusement effect.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
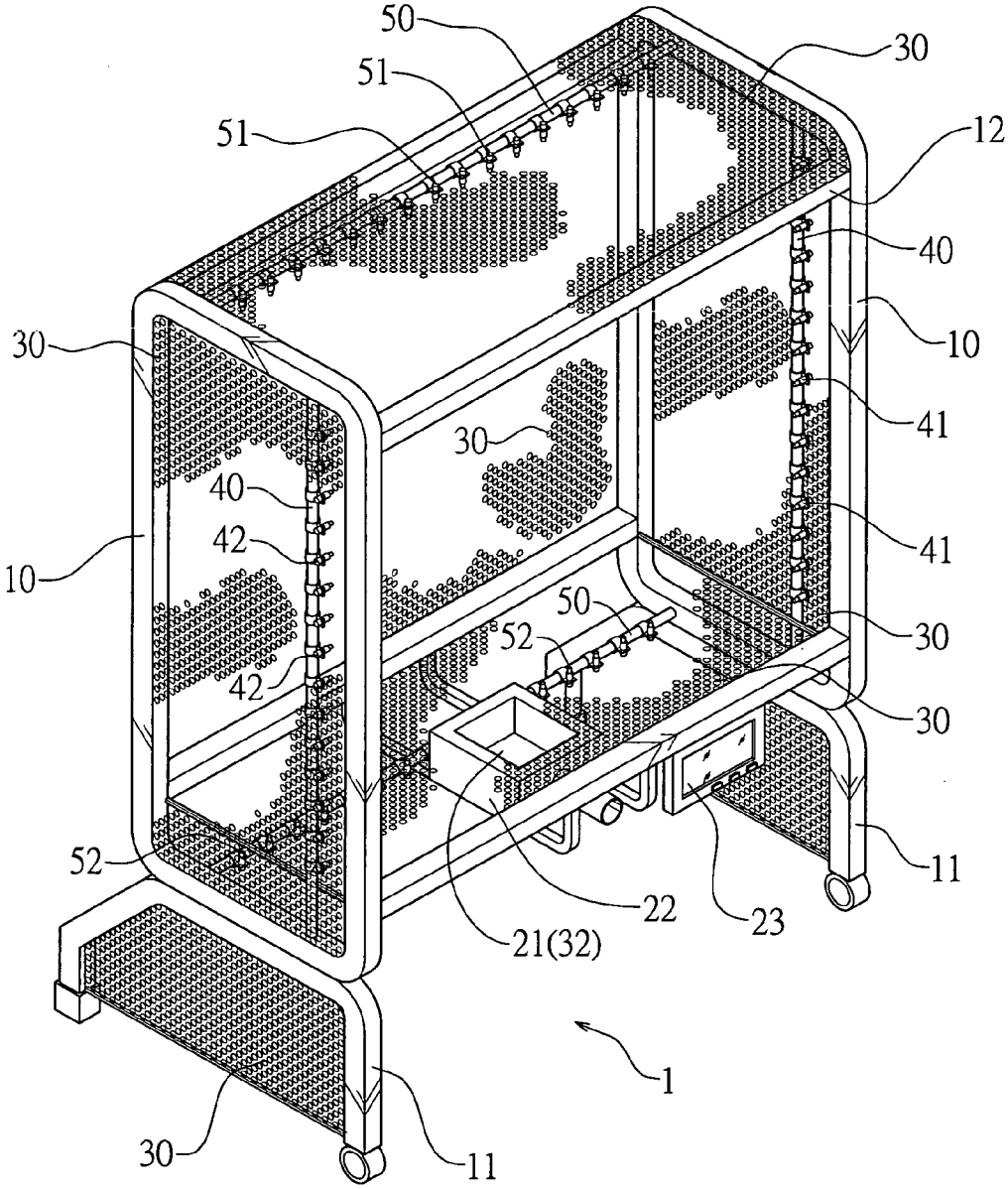
FIG. 1 is a perspective view of a baseball practicing apparatus in accordance with the preferred embodiment of the present invention.
Figure 2:
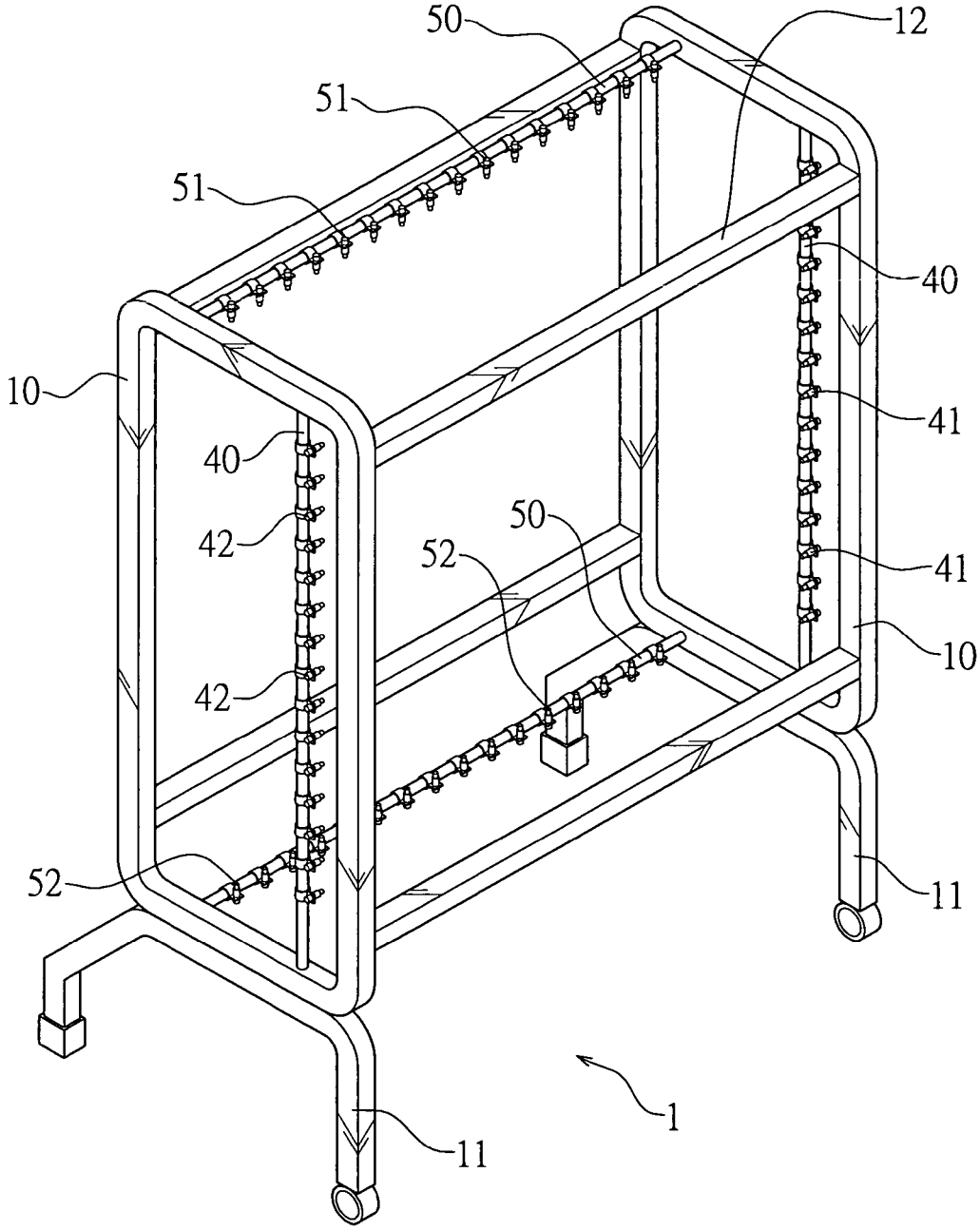
FIG. 2 is a partial perspective view of the baseball practicing apparatus as shown in FIG. 1.

Referring to the drawings and initially to FIGS. 1-4, a baseball practicing apparatus 1 in accordance with the preferred embodiment of the present invention comprises two opposite upright frames 10, two opposite longitudinal rods 40 mounted between the upright frames 10 and provided with a plurality of first emitters 41 and a plurality of first receivers 42 respectively, two opposite transverse rods 50 mounted between the upright frames 10 and provided with a plurality of second emitters 51 and a plurality of second receivers 52 respectively, two stands 11 mounted on and located under the upright frames 10, a buffer net 30 mounted around the upright frames 10 and the stands 11, an ejector 22 mounted on a bottom of the buffer net 30, and an indicator 23 mounted on a bottom of the buffer net 30.

The upright frames 10 are connected by a plurality of transverse bars 12. The bottom of the buffer net 30 is formed with a through hole 32, and the ejector 22 is formed with a through bore 21 aligning with the through hole 32 of the buffer net 30.

The longitudinal rods 40 and the transverse rods 50 are located at different positions of the upright frames 10. The first emitters 41 are mounted on one of the longitudinal rods 40, and the first receivers 42 are mounted on the other one of the longitudinal rods 40. The second emitters 51 are mounted on one of the transverse rods 50, and the second receivers 52 are mounted on the other one of the transverse rods 50.

Thus, the first emitters 41 of the longitudinal rods 40 emit a plurality of first laser beams that are received by the first receivers 42 of the longitudinal rods 40 to form a plurality of transverse sensing lines so that a transverse sensing plane 43 are defined between the longitudinal rods 40 by the first emitters 41 and the first receivers 42 of the longitudinal rods 40. Similarly, the second emitters 51 of the transverse rods 50 emit a plurality of first laser beams that are received by the second receivers 52 of the transverse rods 50 to form a plurality of longitudinal sensing lines so that a longitudinal sensing plane 53 are defined between the transverse rods 50 by the second emitters 51 and the second receivers 52 of the transverse rods 50. The longitudinal sensing plane 53 is separated from the transverse sensing plane 43.

Figure 3:
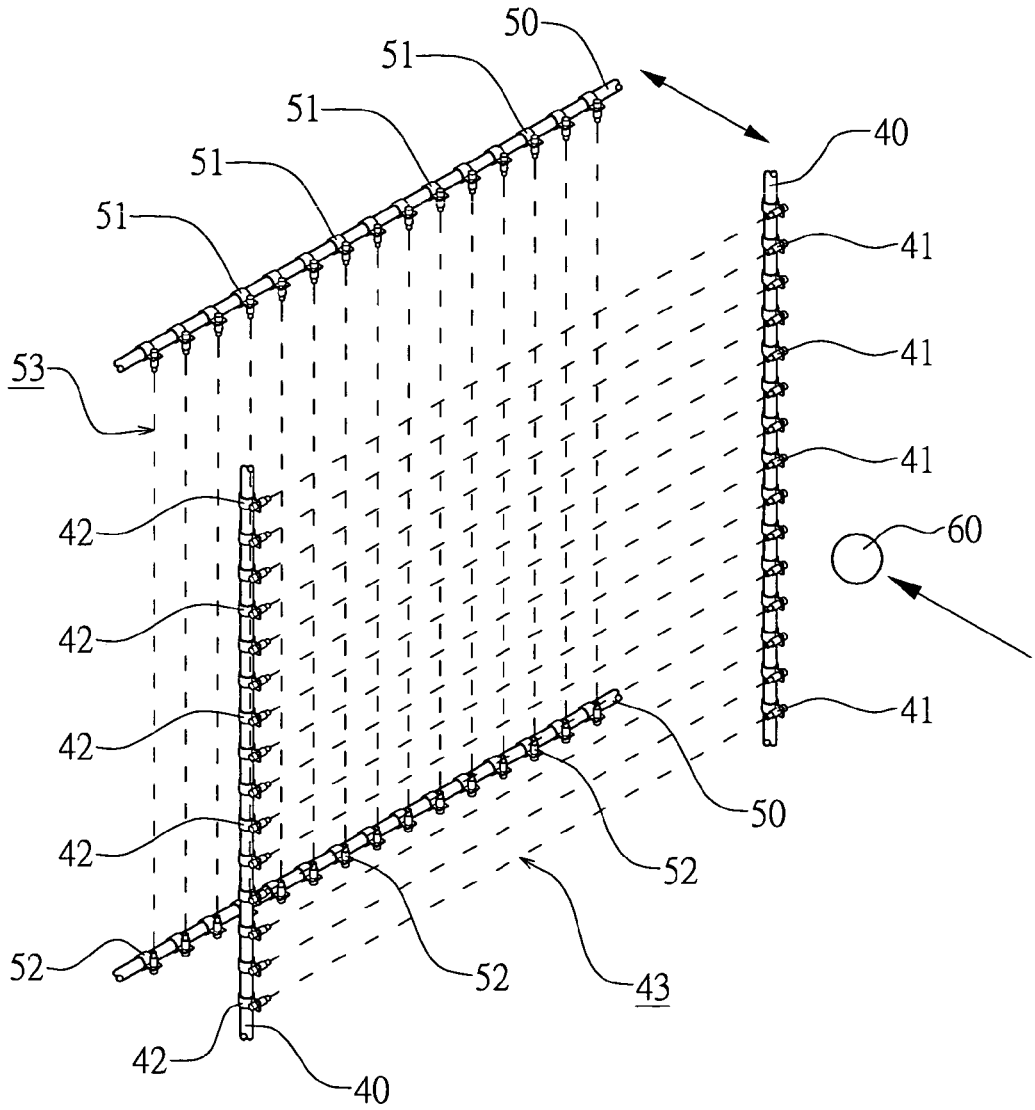
FIG. 3 is a partial perspective view of the baseball practicing apparatus as shown in FIG. 1.

In operation, as shown in FIG. 3, when a baseball 60 passes through the transverse sensing plane 43, the horizontal position of the baseball 60 is detected, and when the baseball 60 passes through the longitudinal sensing plane 53, the longitudinal position of the baseball 60 is detected, so that the transverse sensing plane 43 functions as the x-axis coordinate and the longitudinal sensing plane 53 functions as the y-axis coordinate to detect the planar position of the baseball 60. Thus, the planar position of the baseball 60 is detected by the transverse sensing plane 43 and the longitudinal sensing plane 53.

In addition, the velocity of the baseball 60 is determined by the time period when the baseball 60 passes between the transverse sensing plane 43 and the longitudinal sensing plane 53. The indicator 23 indicates the pitching position of the baseball 60 and the velocity of the baseball 60.

Figure 4:
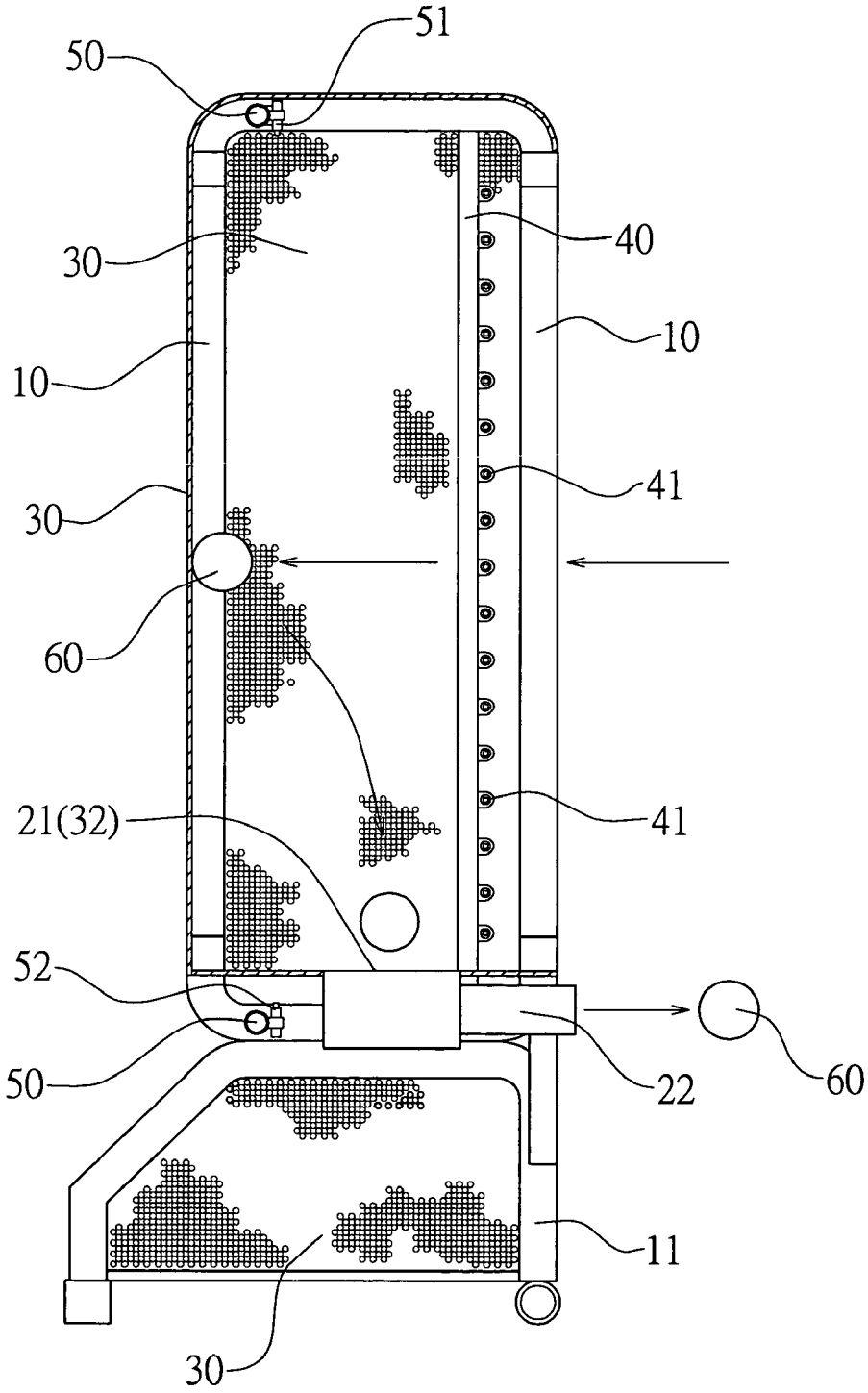
FIG. 4 is a side plan view of the baseball practicing apparatus as shown in FIG. 1.

After the baseball 60 falls onto the buffer net 30, the baseball 60 is introduced into the ejector 22 through the through hole 32 and the through bore 21 and is ejected outwardly from the ejector 22 as shown in FIG. 4 for use with the user again.

Figure 5:
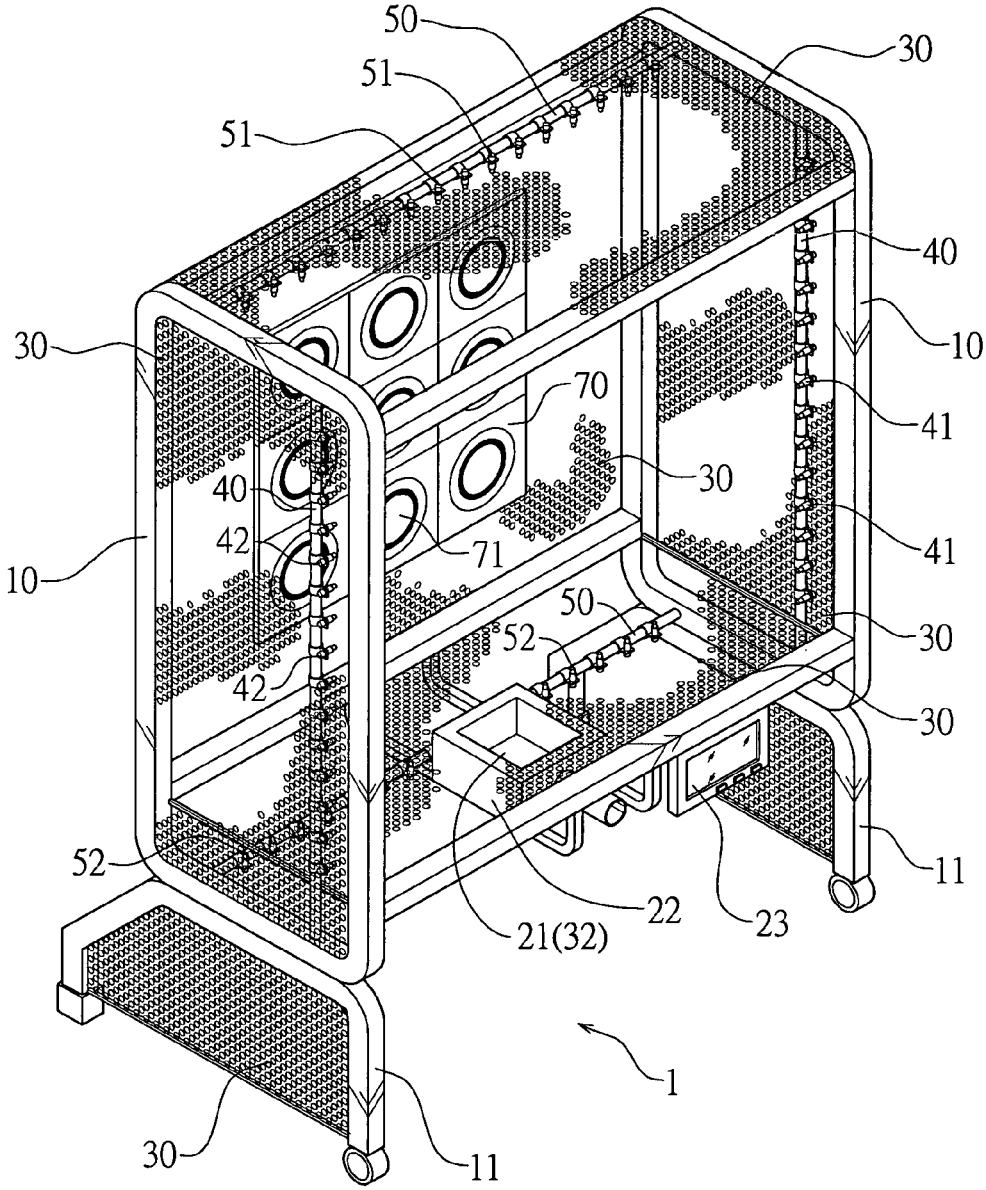
FIG. 5 is a perspective view of a baseball practicing apparatus in accordance with another preferred embodiment of the present invention.

As shown in FIG. 5, the baseball practicing apparatus further comprises a molding board 70 mounted between the upright frames 10 and located on a rear side of the buffer net 30. The molding board 70 has a plurality of target zones 71 to facilitate the user practicing the pitching skill.

Figure 6:
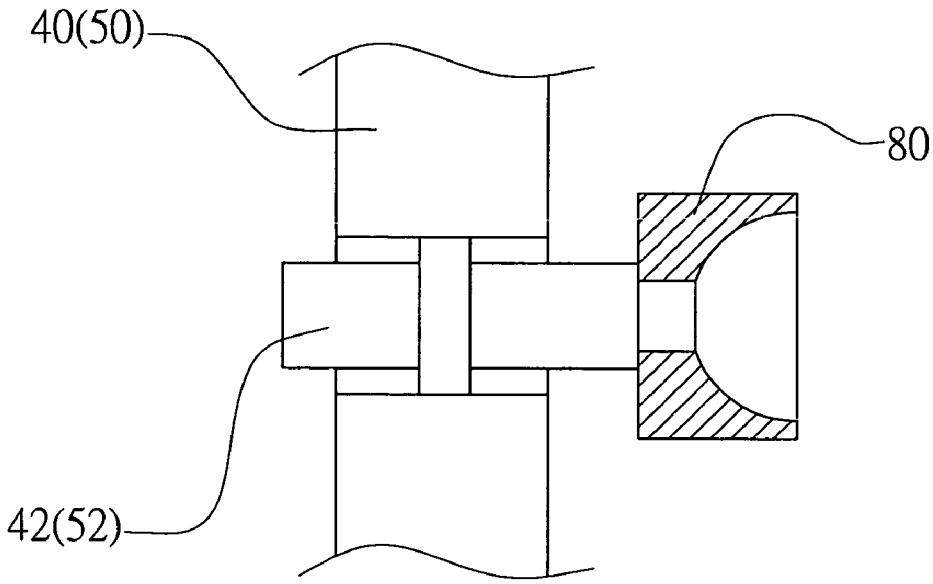
FIG. 6 is a partial plan cross-sectional view of a baseball practicing apparatus in accordance with another preferred embodiment of the present invention.

As shown in FIG. 6, each of the first receivers 42 of the longitudinal rods 40 and the second receivers 52 of the transverse rods 50 has a front end provided with a wide-angle receiving seat 80 to receive the laser beams from the first emitters 41 of the longitudinal rods 40 and the second emitters 51 of the transverse rods 50.

Accordingly, the pitching position of the baseball is detected exactly, so that the user can judge and calibrate the pitching position of the baseball, thereby facilitating the user practicing the pitching skill. In addition, the baseball practicing apparatus detects and displays the pitching position and the velocity of the baseball simultaneously, thereby enhancing the amusement effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A baseball practicing apparatus, comprising:

two opposite upright frames;

two opposite longitudinal rods mounted between the upright frames and provided with a plurality of first emitters and a plurality of first receivers respectively;

two opposite transverse rods mounted between the upright frames and provided with a plurality of second emitters and a plurality of second receivers respectively;

two stands mounted on and located under the upright frames;

a buffer net mounted around the upright frames and the stands;

an ejector mounted on a bottom of the buffer net;

an indicator mounted on a bottom of the buffer net;

wherein the bottom of the buffer net is formed with a through hole, and the ejector is formed with a through bore aligning with the through hole of the buffer net.

2. The baseball practicing apparatus in accordance with claim 1, wherein the longitudinal rods and the transverse rods are located at different positions of the upright frames.

3. The baseball practicing apparatus in accordance with claim 1, wherein the first emitters are mounted on one of the longitudinal rods, and the first receivers are mounted on the other one of the longitudinal rods.

4. The baseball practicing apparatus in accordance with claim 1, wherein the second emitters are mounted on one of the transverse rods, and the second receivers are mounted on the other one of the transverse rods.

5. The baseball practicing apparatus in accordance with claim 1, wherein the first emitters of the longitudinal rods emit a plurality of first laser beams that are received by the first receivers of the longitudinal rods to form a plurality of transverse sensing lines so that a transverse sensing plane are defined between the longitudinal rods by the first emitters and the first receivers of the longitudinal rods.

6. The baseball practicing apparatus in accordance with claim 5, wherein the second emitters of the transverse rods emit a plurality of first laser beams that are received by the second receivers of the transverse rods to form a plurality of longitudinal sensing lines so that a longitudinal sensing plane are defined between the transverse rods by the second emitters and the second receivers of the transverse rods.

7. The baseball practicing apparatus in accordance with claim 6, wherein the longitudinal sensing plane is separated from the transverse sensing plane.

8. The baseball practicing apparatus in accordance with claim 1, wherein the upright frames are connected by a plurality of transverse bars.

9. The baseball practicing apparatus in accordance with claim 1, further comprising a molding board mounted between the upright frames.

10. The baseball practicing apparatus in accordance with claim 9, wherein the molding board is located on a rear side of the buffer net.

11. The baseball practicing apparatus in accordance with claim 9, wherein the molding board has a plurality of target zones.

12. The baseball practicing apparatus in accordance with claim 5, wherein each of the first receivers of the longitudinal rods and the second receivers of the transverse rods has a front end provided with a wide-angle receiving seat to receive the laser beams from the first emitters of the longitudinal rods and the second emitters of the transverse rods.

* * * * *